US008548347B2

(12) United States Patent
Tomita

(10) Patent No.: US 8,548,347 B2
(45) Date of Patent: Oct. 1, 2013

(54) COLOR IMAGE FORMING APPARATUS

(75) Inventor: Norio Tomita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 167 days.

(21) Appl. No.: 13/176,273

(22) Filed: Jul. 5, 2011

(65) Prior Publication Data

US 2012/0008994 A1 Jan. 12, 2012

(30) Foreign Application Priority Data

Jul. 7, 2010 (JP) ..... 2010-154872

(51) Int. Cl.
*G03G 15/00* (2006.01)

(52) U.S. Cl.
USPC ..... 399/72; 399/301

(58) Field of Classification Search
USPC ..... 399/45, 40, 72, 301
See application file for complete search history.

(56) References Cited

U.S. PATENT DOCUMENTS 7,630,657 B2 * 12/2009 Ehara et al. ..... 399/45

FOREIGN PATENT DOCUMENTS

| | | |
|---|---|---|
| JP | 2004-226553 | 8/2004 |
| JP | 2005-099716 | 4/2005 |
| JP | 2007-065500 | 3/2007 |
| JP | 2007-322825 | 12/2007 |
| JP | 2009-150997 | 7/2009 |
| JP | 2009-169031 | 7/2009 |
| JP | 2010-107539 | 5/2010 |

OTHER PUBLICATIONS

JP_2009169031_A_H.pdf—Machine Translation.*

* cited by examiner

*Primary Examiner* — Clayton E Laballe
*Assistant Examiner* — Victor Verbitsky
(74) *Attorney, Agent, or Firm* — Renner, Otto, Boisselle & Sklar, LLP

(57) ABSTRACT

A color image forming apparatus including a test pattern formation portion that forms test patterns of a plurality of colors in an image formation area in which images of the plurality of colors are formed on an image carrier and in an image non-formation area outside the image formation area on the image carrier, a detection portion that detects a shift of each of the test patterns of the plurality of colors formed in the image formation area and a shift of each of the test patterns of the plurality of colors formed in the image non-formation area, a computing portion that obtains, for each color, an offset value indicating an offset between the shift of the test pattern in the image non-formation area and the shift of the test pattern in the image formation area, and a storage portion that stores the offset value for each color.

12 Claims, 7 Drawing Sheets

COLOR IMAGE FORMING APPARATUS

BACKGROUND OF THE INVENTION

This application claims priority under 35 U.S.C. §119(a) on Patent Application No. 2010-154872 filed in Japan on Jul. 7, 2010, the entire contents of which are herein incorporated by reference.

The present invention relates to an electrophotographic color image forming apparatus such as a color printer, a color copying machine, or a color facsimile machine.

In color image forming apparatuses of this type, there is the problem of color shifts since a color image is formed by superimposing images of a plurality of colors. For example, a color image forming apparatus has a configuration in which latent images are respectively written on a plurality of latent image carriers (photosensitive drums) corresponding to a plurality of colors, the latent images on the latent image carriers are developed, and images of the colors are respectively formed on the latent image carriers, transferred from the latent image carriers to an image carrier (transfer belt), superimposed and formed on the image carrier, and further transferred from the image carrier to a recording medium, whereby a color image is formed on the recording medium. In such a color image forming apparatus, images of a plurality of colors may be shifted when the images are transferred from the latent image carriers to the image carrier, and thus a color shift may occur, which deteriorates the quality of a color image.

For this reason, in the invention described in JP 2009-150997A, color shift detection patterns of a plurality of colors are formed in an image formation area of an image carrier (transport belt), shifts of the color shift detection patterns of the colors are detected, and the positions of images of the colors to be formed in the image formation area of the image carrier are corrected based on the shifts of the color shift detection patterns of the colors, thereby preventing color shifts.

However, in the case where such color shift detection patterns of a plurality of colors are formed in the image formation area of the image carrier and detected as in the invention described in JP 2009-150997A, when a normal image is formed in the image formation area, the color shift detection patterns of the colors cannot be formed in the image formation area. Accordingly, it has been necessary to form and detect the color shift detection patterns at the interval of image formation operations or in a state in which an image formation operation is stopped, and thus it has been necessary to set a special period for this.

In the invention described in JP 2005-99716A, an image formation area in the center in the width direction of an image carrier (transfer belt) and image non-formation areas at both edges in the width direction thereof are distinguished, and thus it is possible to detect pitch detection patterns in the image non-formation areas even when an image is formed in the image formation area of the image carrier.

However, the degree of, for instance, color shifts due to so-called bow (curved scanning lines from a light scanning apparatus to a photosensitive body) and the like differs in the center of the image carrier and at both edges thereof. Accordingly, as in the invention described in JP 2005-99716A, even if detection patterns are provided in the image non-formation areas at both edges in the width direction of the image carrier and detected, and then the detection result is used for correction of an image in the center of the image carrier, the correction error was large.

On the other hand, in the invention described in JP 2007-65500A, although bow, for instance, is reduced by pressing a long lens through which scanning beams for latent image writing pass, it is difficult to effectively eliminate color shifts due to bow and the like with such a method. Accordingly, even if the invention described in JP 2005-99716A is combined with the invention described in JP 2007-65500A, color shifts in the center of the image carrier could not be accurately corrected.

As described, in the invention described in JP 2009-150997A, color shift detection patterns of a plurality of colors are formed in the image formation area of the image carrier and detected, and thus it has been necessary to form and detect the color shift detection patterns at the interval of image formation operations or in a state in which an image formation operation is stopped, and thus it has been necessary to set a special period for this.

In the invention described in JP 2005-99716A, since detection patterns in the image non-formation areas of the image carrier are detected, even when an image is formed in the image formation area of the image carrier, the detection patterns can be detected. However, even if the detection result is used for correction of an image in the center of the image carrier, a correction error was large due to the influence of bow and the like.

Furthermore, in the invention described in JP 2007-65500A, although bow, for instance, is reduced by pressing the long lens through which scanning beams pass, it is difficult to effectively eliminate color shifts due to bow and the like. Accordingly, even if the invention described in JP 2005-99716A and the invention described in JP 2007-65500A are combined, color shifts in the center of the image carrier could not be accurately corrected.

SUMMARY OF THE INVENTION

The present invention has been conceived in light of the above conventional problems, and an object thereof is to provide a color image forming apparatus that can detect and correct color shifts even during an image formation operation, and furthermore effectively reduce the influence of bow and the like.

In order to solve the above problems, a color image forming apparatus of the present invention is a color image forming apparatus that forms test patterns of a plurality of colors on an image carrier, detects a shift of each of the test patterns of the plurality of colors formed on the image carrier, and corrects a position of an image of each of the plurality of colors to be formed on the image carrier based on the shifts of the test patterns of the plurality of colors, the apparatus including a test pattern formation portion that forms the test patterns of the plurality of colors in an image formation area in which images of the plurality of colors are formed on the image carrier and in an image non-formation area outside the image formation area on the image carrier, a detection portion that detects a shift of each of the test patterns of the plurality of colors formed in the image formation area and a shift of each of the test patterns of the plurality of colors formed in the image non-formation area, a computing portion that obtains, for each color, an offset value indicating an offset between the shift of the test pattern in the image non-formation area and the shift of the test pattern in the image formation area, and a storage portion that stores the offset value for each color.

In the color image forming apparatus of the present invention as described, the test patterns of the colors are formed in both the image formation area and the image non-formation area of the image carrier, shifts of the test patterns of the colors formed in the image formation area and shifts of the test patterns of the colors formed in the image non-formation area are detected, and for each color, an offset value indicating an offset between a shift of a test pattern in the image non-formation area and a shift of a test pattern in the image formation area is obtained and stored in the storage portion. The shifts of the test patterns of the colors in the image formation area can be derived based on such offset values for the colors and shifts of the test patterns of the colors formed in the image non-formation area. Specifically, without forming the test patterns of the colors in the image formation area and directly detecting the shifts thereof, as long as the offset values for the colors are obtained in advance and stored, the shifts of the test patterns of the colors in the image formation area can be derived by detecting the shifts of the test patterns of the colors formed in the image non-formation area.

In the color image forming apparatus of the present invention, the offset values are obtained in advance and stored in the storage portion, the test pattern formation portion forms the test patterns of the plurality of colors in the image non-formation area, and the detection portion detects a shift of each of the test patterns of the plurality of colors formed in the image non-formation area, the computing portion has a function of obtaining, for each color, a shift of a test pattern in the image formation area based on the shift of the test pattern formed in the image non-formation area and the offset value stored in the storage portion, and positions of images of the plurality of colors to be formed on the image carrier are corrected based on the shifts of the test patterns of the plurality of colors in the image formation area obtained by the computing portion.

If the test patterns of the colors are formed in the image non-formation area, and the shifts of the test patterns of the colors are detected as described, the shifts of the test patterns of the colors in the image formation area can be obtained based on the offset values for the colors and the shifts of the test patterns of the colors, and the positions of images of the colors in the image formation area can be corrected. Specifically, without forming the test patterns of the colors in the image formation area, by obtaining the shifts thereof, the positions of images of the colors in the image formation area can be corrected.

Furthermore, in the color image forming apparatus of the present invention, formation of the test patterns in the image non-formation area by the test pattern formation portion and detection of the shifts of the test patterns in the image non-formation area by the detection portion are performed when images of the plurality of colors are formed in the image formation area.

Since it is not necessary to form the test patterns of the colors in the image formation area, even when images of the colors are formed in the image formation area, it is possible to correct the positions of images of the colors in the image formation area by forming the test patterns in the image non-formation area and detecting the shifts thereof.

In the color image forming apparatus of the present invention, formation of the test patterns in the image formation area and the test patterns in the image non-formation area by the test pattern formation portion and detection of the shifts of the test patterns in the image formation area and the shifts of the test patterns in the image non-formation area by the detection portion are performed when images of the plurality of colors are not formed in the image formation area.

In order to obtain offset values for the colors, it is necessary to form the test patterns of the colors in the image formation area and in the image non-formation area of the image carrier, and detect the shifts of the test patterns of the colors. Accordingly, offset values for the colors are derived when images of the colors are not formed in the image formation area. As described, the offset values for the colors are obtained and stored in the storage portion, and thereafter shifts of test patterns of the colors in the image formation area are obtained, based on the offset values for the colors and the shifts of the test patterns of the colors in the image non-formation area.

In the color image forming apparatus of the present invention, the image non-formation area is provided on both sides of the image carrier, and the image formation area is provided between the image non-formation areas on the image carrier, the test pattern formation portion forms the test patterns of the plurality of colors in both edge portions of the image formation area and in the image non-formation areas, the detection portion, for each color, divides the test patterns in both edge portions of the image formation area and the test patterns in the image non-formation areas into two groups each made up of adjacent patterns, and obtains, for each group, an offset value indicating an offset between a shift of the test pattern in the image non-formation area and a shift of the test pattern in the image formation area, and the storage portion stores two offset values for each color.

By obtaining and using two offset values as described, it is possible to more accurately correct the positions of images of the colors to be formed on the image carrier.

Furthermore, in the color image forming apparatus of the present invention, a position of a test pattern of one of the plurality of colors is used as a reference position, and a shift of each of the test patterns of the plurality of colors is obtained as a shift of a position of a test pattern of another color relative to the reference position.

The color image forming apparatus of the present invention includes a latent image carrier for each of the plurality of colors, a latent-image writing portion that writes a latent image on each of the latent image carriers, a development portion that develops the latent image on each of the latent image carriers, and forms images of the plurality of colors on the latent image carriers, and a transfer portion that transfers the images of the plurality of colors from the latent image carriers to the image carrier, and forms the images of the plurality of colors on the image carrier, wherein the latent-image writing portion adjusts a writing timing at which a latent image is written on each of the latent image carriers according to the shifts of the test patterns of the plurality of colors obtained by the computing portion, and corrects positions of images of the plurality of colors to be formed on the image carrier.

Here, latent images are respectively written on the plurality of latent image carriers (photosensitive drums) corresponding to the colors, and the latent images on the latent image carriers are developed. Then, images of the colors are respectively formed on the latent image carriers, transferred from the latent image carriers to the image carrier (transfer belt), superimposed and formed on the image carrier, and further transferred from the image carrier to a recording medium, whereby a color image is formed on the recording medium. In this case, the positions of images of the colors to be formed on the image carrier can be corrected by adjusting writing timings at which latent images are respectively written on the latent image carriers.

Note that the present invention is also applicable to color image forming apparatuses having other configurations. For example, the present invention is also applicable to a color image forming apparatus that directly transfers images of the colors from latent image carriers to a recording medium (recording paper).

According to the present invention as described, the test patterns of the colors are formed in all the image formation area and the image non-formation areas of the image carrier, shifts of the test patterns of the colors formed in the image formation area and shifts of the test patterns of the colors formed in the image non-formation areas are detected, and for each color, an offset value indicating an offset between a shift of a test pattern in the image non-formation area and a shift of a test pattern in the image formation area is obtained and stored in the storage portion. The shifts of the test patterns of the colors in the image formation area can be derived based on such offset values for the colors and shifts of the test patterns of the colors formed in the image non-formation areas. Specifically, without forming the test patterns of the colors in the image formation area and directly detecting the shifts thereof, as long as the offset values for the colors are obtained in advance and stored, the shifts of the test patterns of the colors in the image formation area can be derived by detecting the shifts of the test patterns of the colors formed in the image non-formation areas.

Figure 4:
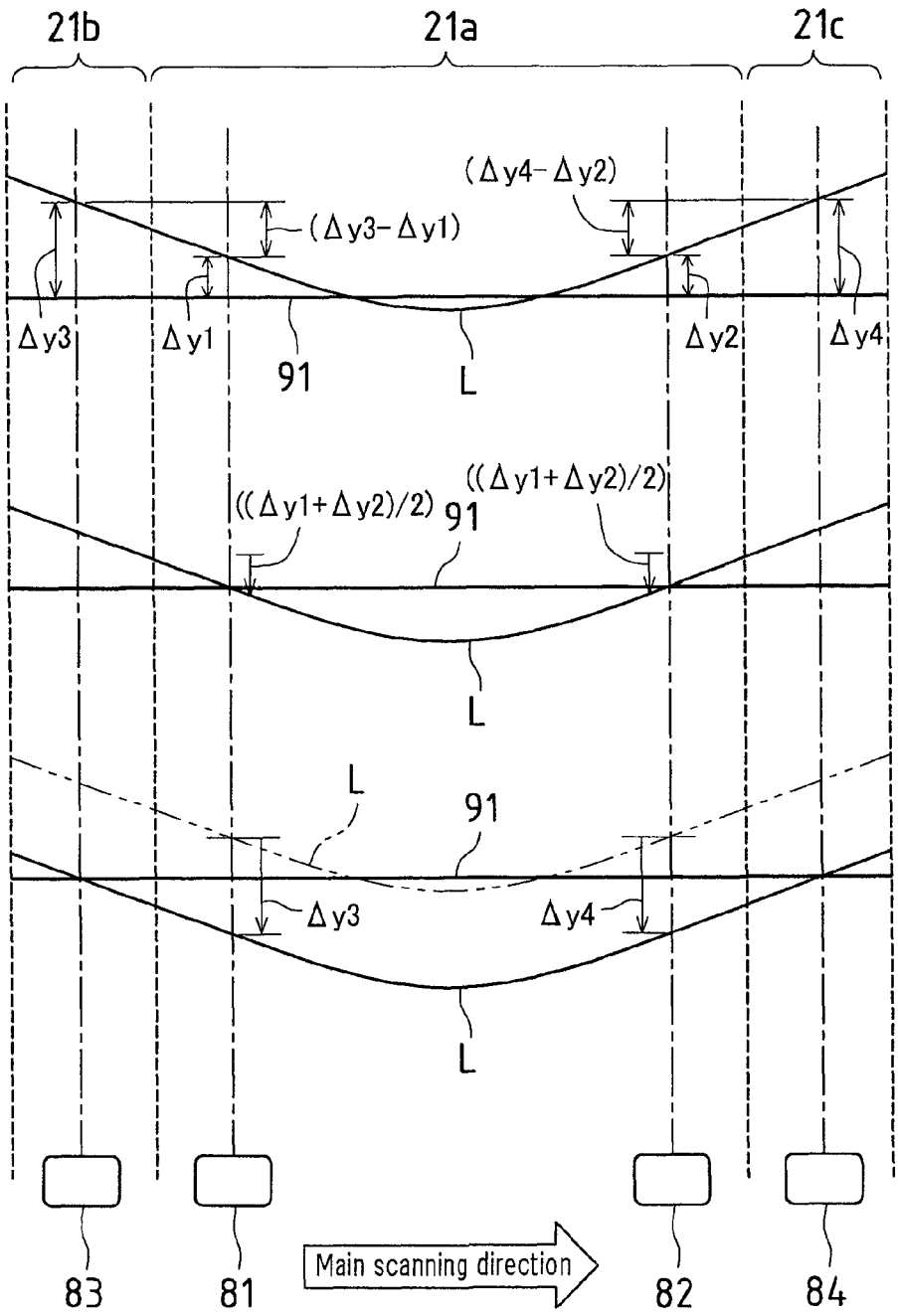

An upper diagram of FIG. 4 shows shifts $\Delta y1$ and $\Delta y2$ in the sub-scanning direction of a main scanning line at both edge portions of an image formation area of the intermediate transfer belt, shifts $\Delta y3$ and $\Delta y4$ in the sub-scanning direction of the main scanning line in image non-formation areas, a first sub-scanning offset value ($\Delta y3-\Delta y1$), and a second sub-scanning offset value ($\Delta y4-\Delta y1$), a middle diagram of FIG. 4 shows a main scanning line whose position has been adjusted by an average shift $(\Delta y1+\Delta y2)/2$ in the sub-scanning direction, and a lower diagram of FIG. 4 shows a main scanning line whose position has been adjusted by the shifts $\Delta y3$ and $\Delta y4$ in the sub-scanning direction in the image non-formation areas.

Figure 5:
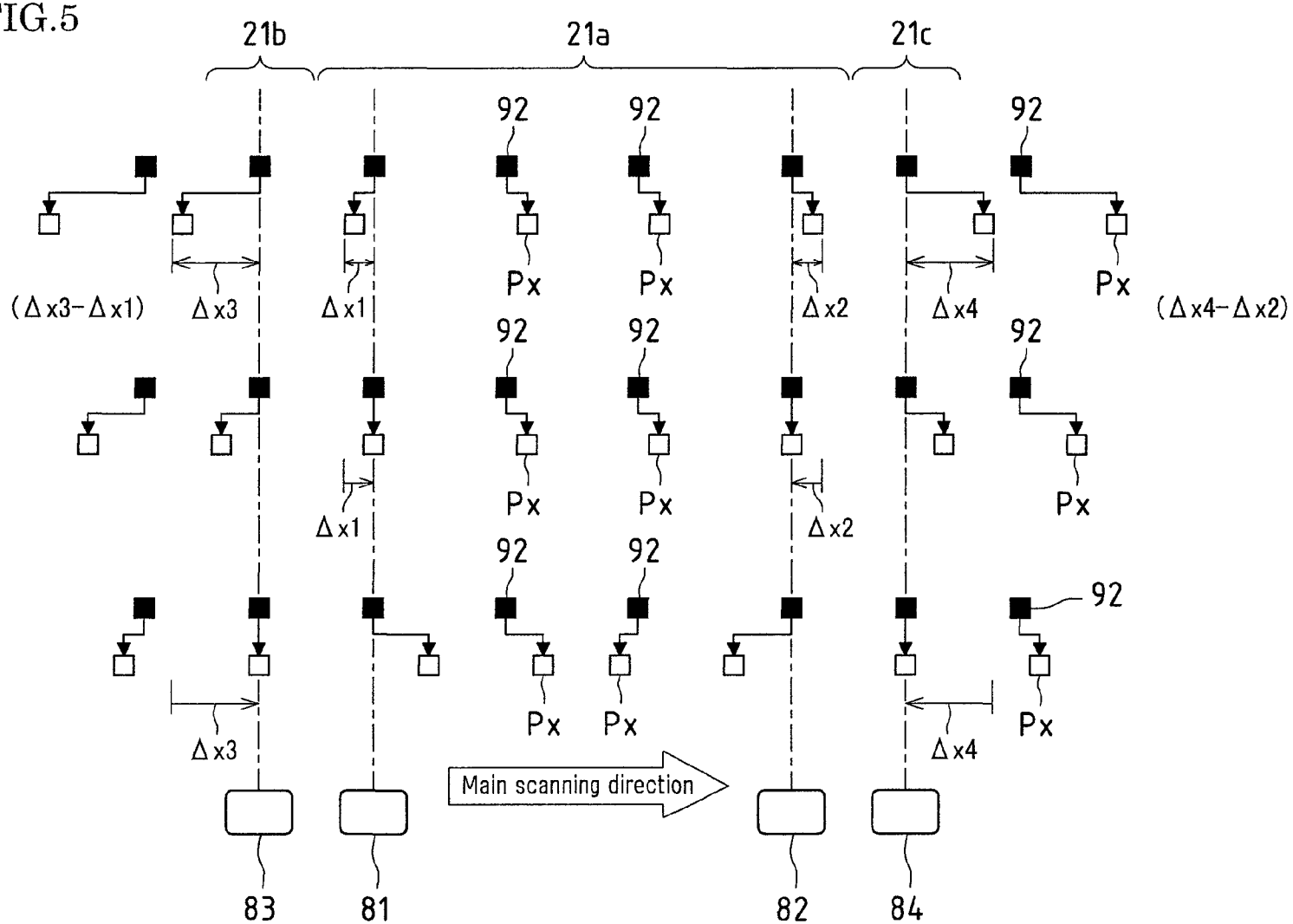

An upper diagram of FIG. 5 shows shifts $\Delta x1$ and $\Delta x2$ in the main scanning direction of the main scanning line at both edge portions of the image formation area of the intermediate transfer belt, shifts $\Delta x3$ and $\Delta x4$ in the main scanning direction of the main scanning line in the image non-formation areas, a first main scanning offset value ($\Delta x3-\Delta x1$), and a second main scanning offset value ($\Delta x4-\Delta x2$), a middle diagram of FIG. 5 shows pixels Px on a main scanning line L whose position has been adjusted by the shifts $\Delta x1$ and $\Delta x2$ in the main scanning direction at both edge portions of the image formation area, and a lower diagram of FIG. 5 shows pixels Px on a main scanning line L whose position has been adjusted by the shifts $\Delta x3$ and $\Delta x4$ in the main scanning direction in the image non-formation areas.

Figure 6:
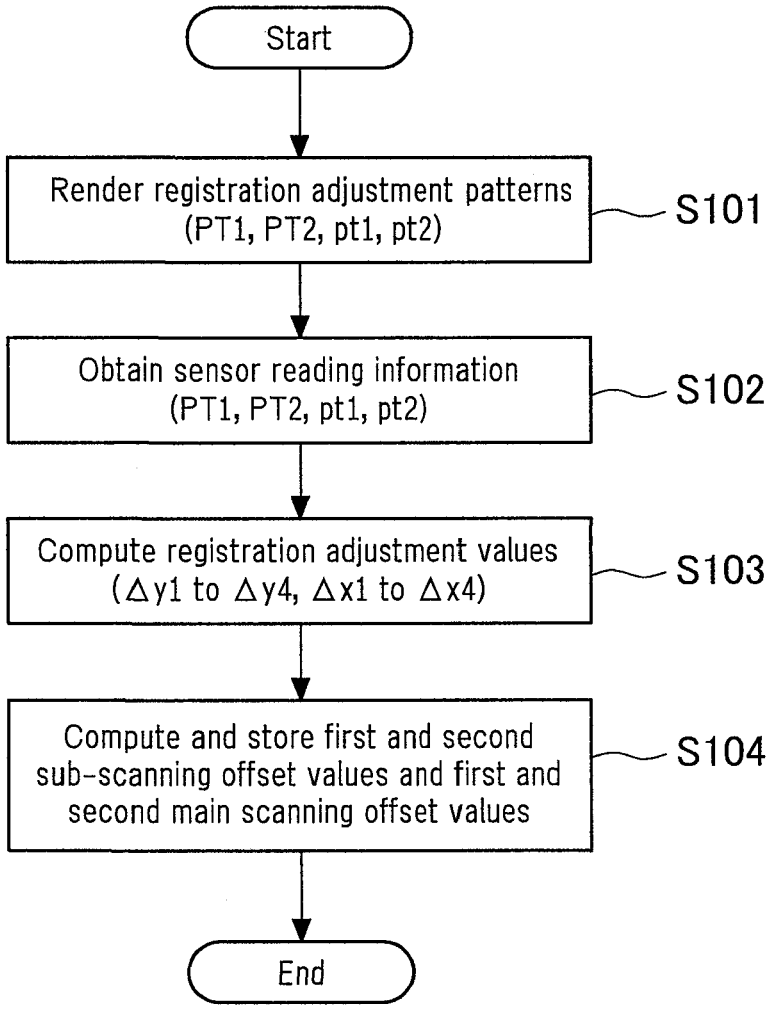

FIG. 6 is a flowchart showing a procedure for obtaining the first and second sub-scanning offset values and the first and second main scanning offset values.

Figure 7:
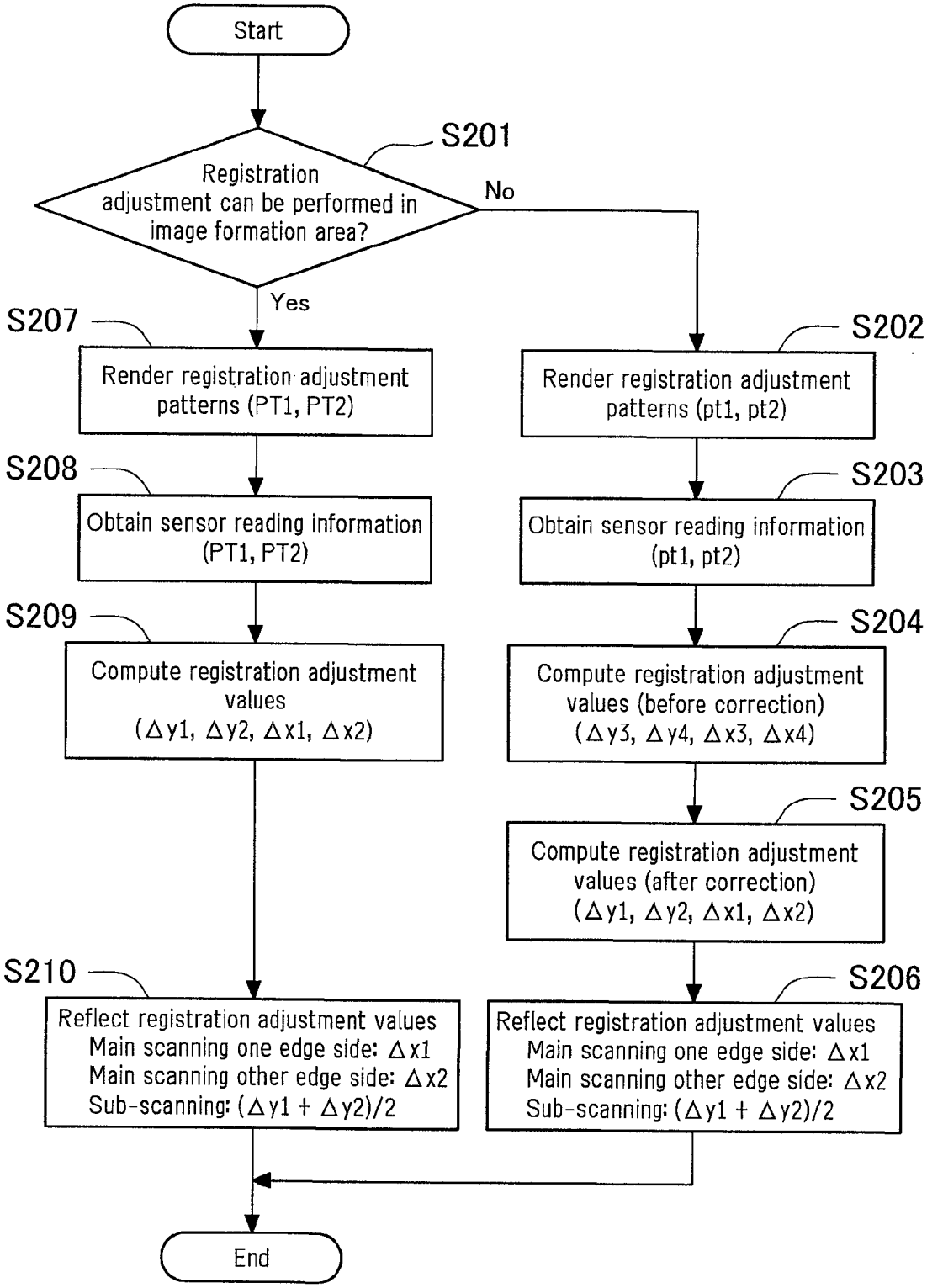

FIG. 7 is a flowchart showing a procedure for obtaining an average shift in the sub-scanning direction in the image formation area of the intermediate transfer belt and shifts in the main scanning direction at both edge portions of the image formation area.

DESCRIPTION OF PREFERRED EMBODIMENTS

The following is a detailed description of an embodiment of the present invention with reference to accompanying drawings.

Figure 1:
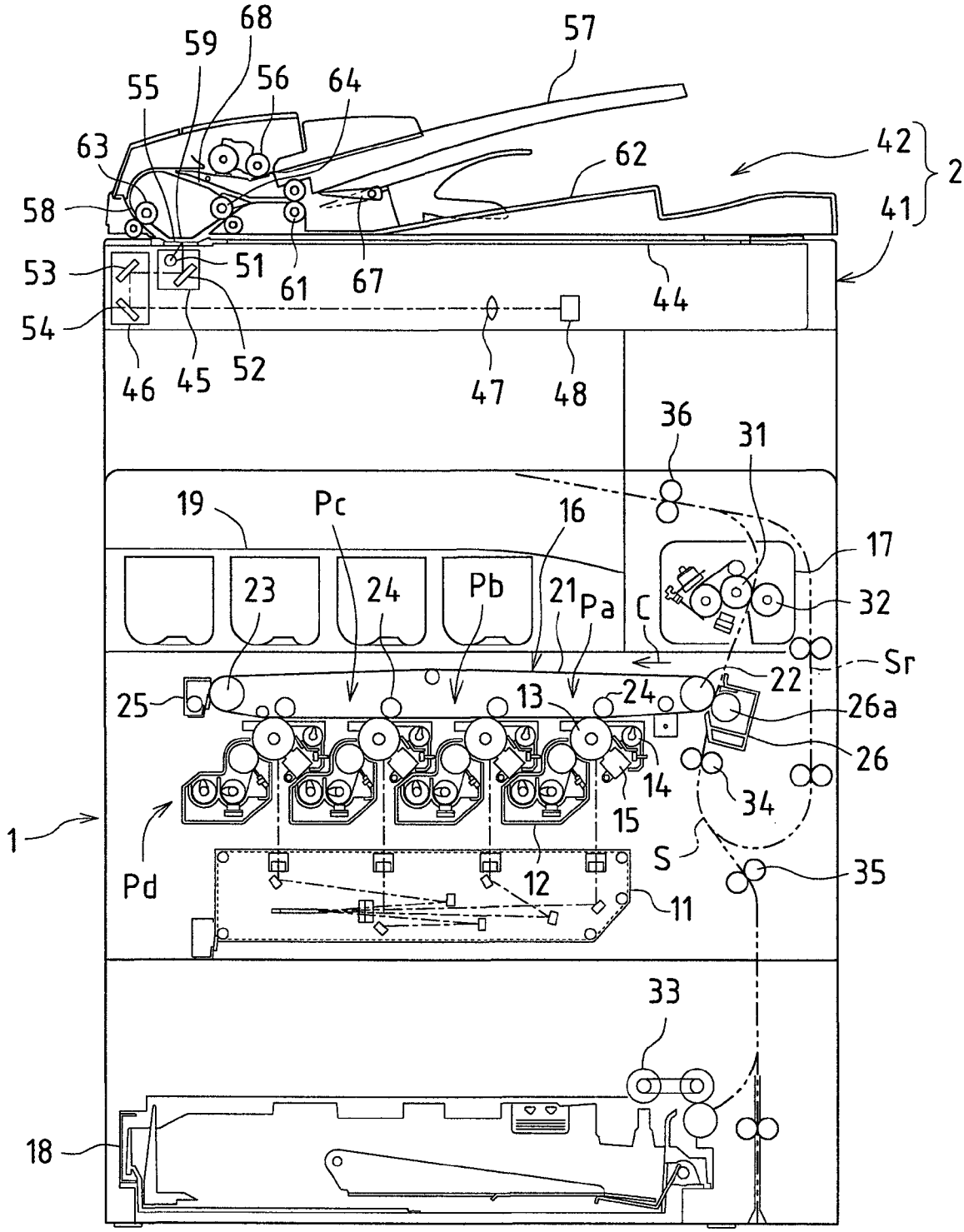
FIG. 1 is a cross-sectional view showing one embodiment of a color image forming apparatus of the present invention.

FIG. 1 is a cross-sectional view showing one embodiment of a color image forming apparatus of the present invention. This color image forming apparatus 1 is a so-called multi-function peripheral that has a scanner function, a copying function, a printer function, a facsimile function, and the like, and transmits an image of an original read by an image reading apparatus 41 to the outside (which corresponds to the scanner function), and records and forms the image of the read original or an image received from the outside onto recording paper in color or monochrome (which corresponds to the copying function, the printer function, and the facsimile function).

In order to print an image on recording paper, the color image forming apparatus 1 is provided with a laser exposing apparatus 11, development apparatuses 12, photosensitive drums 13, drum cleaning apparatuses 14, charging units 15, an intermediate transfer belt apparatus 16, a fixing apparatus 17, a paper transport path S, a paper feed tray 18, a paper discharge tray 19, and the like.

Image data handled in the color image forming apparatus 1 corresponds to a color image using black (K), cyan (C), magenta (M), and yellow (Y), or corresponds to a monochrome image using a single color (for example, black). Accordingly, four each of the development apparatuses 12, the photosensitive drums 13, the drum cleaning apparatuses 14, and the charging units 15 are provided such that four types of toner images corresponding to the colors are formed, with these being respectively associated with black, cyan, magenta, and yellow, thereby constituting four image stations Pa, Pb, Pc, and Pd.

The photosensitive drums 13 each have a photosensitive layer on the surface thereof. The charging units 15 serve as charging means for respectively charging the surface of the photosensitive drums 3 uniformly to a predetermined potential, and contact roller-type or contact brush-type charging units, or otherwise charger-type charging units are used.

The laser exposing apparatus 11 is a laser scanning unit (LSU) provided with laser diodes and reflection mirrors, and exposes the charged surface of the photosensitive drums 3 according to image data to form electrostatic latent images according to the image data on the surface thereof.

The development apparatuses 12 develop the electrostatic latent images respectively formed on the surface of the photosensitive drums 13 with toner of the colors, and form a toner image on the surface of the photosensitive drums 13. The drum cleaning apparatuses 14 respectively remove and collect toner remaining on the surface of the photosensitive drums 13 after development and image transfer.

The intermediate transfer belt apparatus 16 is disposed above the photosensitive drums 13, and is provided with an intermediate transfer belt 21, an intermediate transfer belt drive roller 22, an idler roller 23, four intermediate transfer rollers 24, and a belt cleaning apparatus 25.

The intermediate transfer belt 21 is formed as an endless belt using a film. The intermediate transfer belt drive roller 22, the idler roller 23, the intermediate transfer rollers 24, and the like support the intermediate transfer belt 21 in a tensioned manner, and revolve the intermediate transfer belt 21 in the direction of arrow C.

The intermediate transfer rollers 24 are rotatably supported in the vicinity of the intermediate transfer belt 21, and respectively pressed against the photosensitive drums 13 via the intermediate transfer belt 21. The toner images on the surface of the photosensitive drums 13 are sequentially transferred and superimposed on the intermediate transfer belt 21, whereby a color toner image (toner images of the colors) is formed on the intermediate transfer belt 21. The toner images are transferred from the photosensitive drums 13 to the intermediate transfer belt 21, using the intermediate transfer rollers 24 pressed against the back surface of the intermediate transfer belt 21. The intermediate transfer rollers 24 are rollers each having a metal (for example, stainless steel) shaft as a base, with the surface of that shaft being covered with a conductive elastic material (for example, such as EPDM or urethane foam). A high voltage transfer bias (a high voltage of opposite polarity (+) to the toner charging polarity (−)) is applied to the intermediate transfer rollers 24 in order to transfer toner images, and a high voltage is uniformly applied to recording paper with the conductive elastic material.

The toner images on the surface of the photosensitive drums 13 are transferred and layered on the intermediate transfer belt 21 in this way, and become a color toner image indicated by the image data. This color toner image is transported together with the intermediate transfer belt 21, and transferred onto recording paper in a nip region between the intermediate transfer belt 21 and a transfer roller 26*a* of a secondary transfer apparatus 26.

A voltage (a high voltage of opposite polarity (+) to the toner charging polarity (−)) for transferring the toner images of the colors on the intermediate transfer belt 21 to the recording paper is applied to the transfer roller 26*a* of the secondary transfer apparatus 26.

The toner images on the intermediate transfer belt 21 may not be completely transferred onto the recording paper by the secondary transfer apparatus 26, thus causing toner to remain on the surface of the intermediate transfer belt 21. This remaining toner causes toner color mixing to occur in a subsequent process. Accordingly, the belt cleaning apparatus 25 removes and collects the remaining toner on the surface of the intermediate transfer belt 21. The belt cleaning apparatus 25 is provided with, for example, a cleaning blade that removes remaining toner by being in contact with the surface of the intermediate transfer belt 21 as a cleaning member. The back side of the intermediate transfer belt 21 is supported by the idler roller 23 at a site where the cleaning blade is in contact.

The recording paper is transported to the fixing apparatus 17 after the color toner image has been transferred thereto in the nip region between the intermediate transfer belt 21 and the transfer roller 26*a* of the secondary transfer apparatus 26. The fixing apparatus 17 is provided with a heat roller 31, a pressure roller 32, and the like, and sandwiches and transports the recording paper between the heat roller 31 and the pressure roller 32.

The heat roller 31 is controlled so as to have a prescribed fixing temperature based on the detection output of a temperature detector (not shown), and fuses, mixes, and applies pressure to the color toner image transferred onto the recording paper by applying heat and pressure to the recording paper together with the pressure roller 32, thus thermally fixing that color toner image on the recording paper.

The paper feed tray 18 for supplying recording paper is provided in the lower part of the color image forming apparatus 1. The color image forming apparatus 1 is provided with the paper transport path S for feeding recording paper supplied from the paper feed tray 18 to the paper discharge tray 19 via the secondary transfer apparatus 26 and the fixing apparatus 17.

A paper pickup roller 33 is provided at an edge portion of the paper feed tray 18, and recording paper is drawn out sheet-by-sheet from the paper feed tray 18 and transported to the paper transport path S by the paper pickup roller 33.

Paper registration rollers 34, the fixing apparatus 17, transport rollers 35, paper discharge rollers 36, and the like are disposed along the paper transport path S. The transport rollers 35 are small rollers for promoting and assisting the transport of recording paper, and a plurality of sets thereof are provided.

The paper registration rollers 34 temporarily stop the transported recording paper and align the leading edge of the recording paper, and then transport the recording paper in a timely manner in coordination with the rotation of the photosensitive drums 13 and the intermediate transfer belt 21 such that the color toner image on the intermediate transfer belt 21 is transferred onto the recording paper in the nip region between the intermediate transfer belt 21 and the transfer roller 26*a* of the secondary transfer apparatus 26.

Furthermore, the color toner image is fixed onto the recording paper by the fixing apparatus 17, and the recording paper passes through the fixing apparatus 17, and thereafter the recording paper is discharged facedown on the paper discharge tray 19 by the paper discharge rollers 36.

Further, if printing is performed not only on the front surface of recording paper, but also on the back surface, while the recording paper is being transported by the paper discharge rollers 36, the paper discharge rollers 36 are stopped and then rotated in reverse, the front and back of the recording paper are reversed by causing the recording paper to pass through a reverse path Sr, and then the recording paper is guided to the paper registration rollers 34. As in the case of the front surface of the recording paper, an image is recorded and fixed onto the back surface of the recording paper, and the recording paper is discharged onto the paper discharge tray 19.

The following is a description of the image reading apparatus 41 and an original transport apparatus 42 that are mounted in the upper part of the main body of the color image forming apparatus 1. One far side of the original transport apparatus 42 is pivotably supported by a hinge (not shown) on one far side of the image reading apparatus 41, and the original transport apparatus 42 is opened and closed by the near portion thereof being raised or lowered. When the original transport apparatus 42 is opened, a platen glass 44 of the image reading apparatus 41 is released, and an original is placed on this platen glass 44.

The image reading apparatus 41 is provided with the platen glass 44, a first scanning unit 45, a second scanning unit 46, an imaging lens 47, a CCD (Charge Coupled Device) 48, and the like. The first scanning unit 45 is provided with an illuminating apparatus 51 and a first reflection mirror 52. While moving in the sub-scanning direction at a fixed speed V by the distance according to the original size, the first scanning unit 45 exposes the original on the platen glass 44 with the illuminating apparatus 51, and reflects the reflected light using the first reflection mirror 52 so as to guide the light to the second scanning unit 46, thereby scanning an image on the original surface in the sub-scanning direction. The second scanning unit 46 is provided with second and third reflection mirrors 53 and 54, reflects the reflected light from the original using the second and third reflection mirrors 53 and 54 so as to guide the light to the imaging lens 47 while moving at a speed V/2, following the first scanning unit 45. The imaging lens 47 collects the reflected light from the original onto the CCD 48, and forms the image on the original surface on the CCD 48. The CCD 48 repeatedly scans the image of the original in the main scanning direction, and outputs analog image signals for one main scanning line at each scan.

The image reading apparatus 41 can read not only a stationary original, but also an image on the surface of an original that is being transported by the original transport apparatus 42. In this case, the first scanning unit 45 is moved to a reading range under an original reading glass 55, the second scanning unit 46 is positioned according to the position of the first scanning unit 45, and the transport of an original by the original transport apparatus 42 is started in this state.

In the original transport apparatus 42, a pickup roller 56 is pressed against originals on an original tray 57 and rotated to draw out an original, and then the original is transported through an original transport path 58, caused to pass between the original reading glass 55 and a reading guide plate 59, and further transported from paper discharge rollers 61 to a discharge tray 62. A registration roller 63 that transports an original after aligning the leading edge thereof, and a transport roller 64 that transports the original are disposed along the original transport path 58.

In the original transport, the original surface is illuminated via the original reading glass 55 by the illuminating apparatus 51 of the first scanning unit 45, the reflected light from the original surface is guided to the imaging lens 47 by the reflection mirrors of the first and second scanning units 45 and 46, the reflected light from the original surface is collected on the CCD 48 by the imaging lens 47, and an image on the original surface is formed on the CCD 48, whereby the image on the original surface is read.

In the case where the back surface of an original is read, an intermediate tray 67 is rotated about a shaft thereof as shown by the dotted line, the paper discharge rollers 61 are stopped while an original is being discharged from the paper discharge rollers 61 to the discharge tray 62, and the original is received on the intermediate tray 67. Then, the paper discharge rollers 61 are rotated in reverse so as to guide the original to the registration roller 63 via a reverse transport path 68, whereby the front and back of the original are reversed, and as in the case of an image on the front surface of the original, an image on the back surface of the original is read, the intermediate tray 67 is returned to the original position shown by the solid line, and then the original is discharged from the paper discharge rollers 61 to the discharge tray 62.

The image of the original read by the CCD 48 in this way is outputted as analog image signals from the CCD 48, and the analog image signals are A/D converted into digital image signals (image data). Then, this image data undergoes various image processing, and thereafter is sent to and received by the laser exposing apparatus 11 of the color image forming apparatus 1. In the color image forming apparatus 1, the image is recorded on recording paper, and this recording paper is outputted as a copied original.

Figure 2:
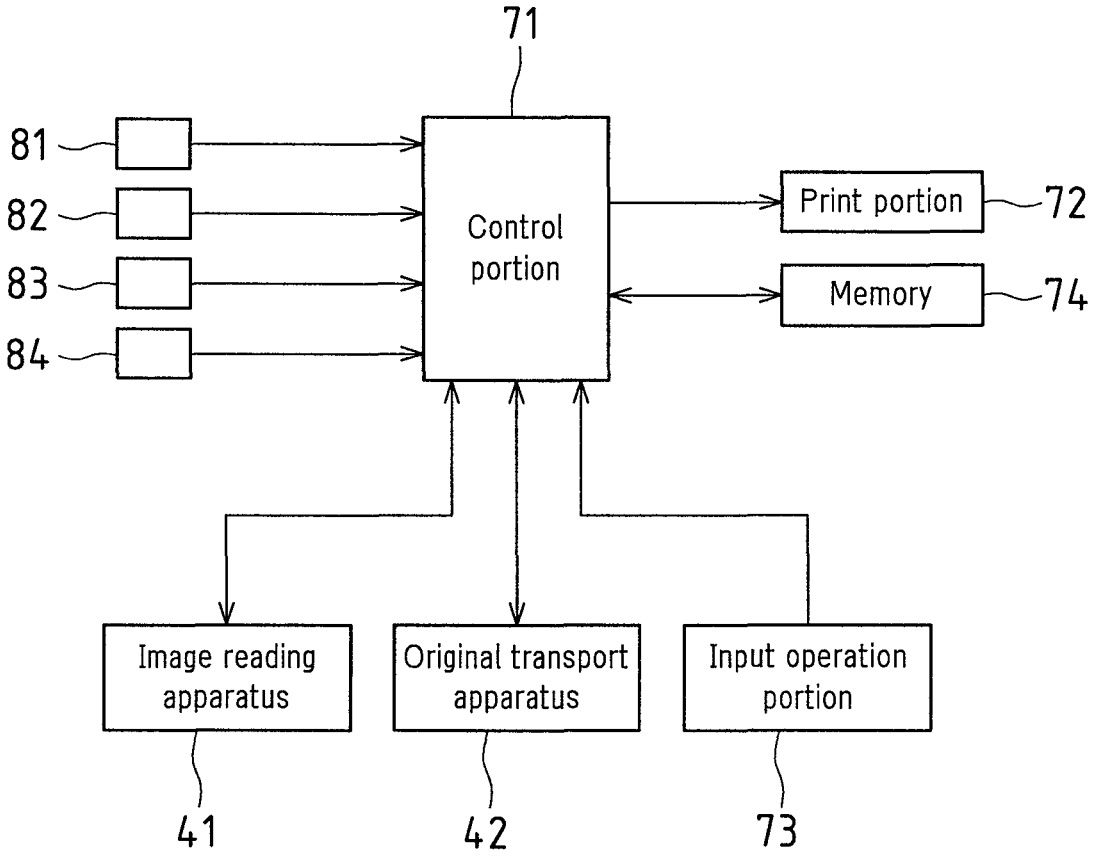
FIG. 2 is a block diagram showing a control system of the color image forming apparatus in FIG. 1.

FIG. 2 is a block diagram showing a control system of the color image forming apparatus 1 according to the present embodiment. In FIG. 2, a control portion (computing portion) 71 performs overall control of the color image forming apparatus 1, and is constituted by a CPU, a RAM, a ROM, various interfaces, and so on. A print portion 72 corresponds to, for instance, the laser exposing apparatus 11, the development apparatuses 12, the photosensitive drums 13, the drum cleaning apparatuses 14, the charging units 15, the intermediate transfer belt apparatus 16, the fixing apparatus 17, the paper transport path S, the paper feed tray 18, and the paper discharge tray 19 in FIG. 1, and prints a print image on recording paper using an electrophotographic system.

An input operation portion 73 is constituted by a plurality of input keys and a liquid crystal display apparatus, for example. A memory (storage portion) 74 is, for example, a hard disk apparatus (HDD), and stores various data and programs. Four registration sensors (detection portions) 81 to 84 detect test patterns formed on the intermediate transfer belt 21 of the intermediate transfer belt apparatus 16.

For example, the control portion 71 causes the original transport apparatus 42 to transport an original and the image reading apparatus 41 to read an image of the original by controlling the image reading apparatus 41 and the original transport apparatus 42, causes the memory 74 to store image data indicating the image of the original, and causes the print portion 72 to record the image of the original indicated by the image data in the memory 74 on recording paper by controlling the print portion 72.

However, since images of the colors are respectively formed on the photosensitive drums 13 of the image forming stations Pa, Pb, Pc, and Pd, and thereafter the images on the photosensitive drums 13 are sequentially transferred, superimposed, and formed on the intermediate transfer belt 21, transfer positions (image positions) of the images of the colors on the intermediate transfer belt 21 may be shifted, thereby causing color shifts to occur, and thus the quality of a color image may deteriorate.

In view of this, test patterns of the colors are respectively formed on the photosensitive drums 13 of the image forming stations Pa, Pb, Pc, and Pd, the test patterns of the colors on the photosensitive drums 13 are transferred onto the intermediate transfer belt 21, recording positions of the test patterns of the colors on the intermediate transfer belt 21 are detected, and shifts thereof are detected from the recording positions of the test patterns of the colors. The positions of images of the colors to be formed on the photosensitive drums 13 are corrected based on the shifts of the test patterns of the colors, and the images on the photosensitive drums 13 are accurately transferred, superimposed, and formed on the intermediate transfer belt 21, thereby preventing color shifts. The image positions on the photosensitive drums 13 are corrected normally by, for instance, controlling writing timings at which electrostatic latent images are written on the photosensitive drums 13 using scanning beams emitted from the laser diodes of the laser exposing apparatus 11. The image positions in the sub-scanning direction are corrected by adjusting sub-scanning direction positions of main scanning lines on the photosensitive drums 13, and the image positions in the main scanning direction are corrected by adjusting the length and main scanning direction positions of the main scanning lines on the photosensitive drums 13.

Specifically, since there is an image non-formation area on both sides of an image formation area of the intermediate transfer belt 21, test patterns of the colors are formed in both edge portions of the image formation area and in the image non-formation areas, and for each color, the test patterns in both edge portions of the image formation area and the test patterns in the image non-formation areas are divided into two groups each made up of adjacent test patterns. Then, an offset value indicating an offset between a shift of the test pattern in the image non-formation area and a shift of the test pattern in the image formation area is obtained for each group, and these offset values are stored in the memory 74. In this way, two offset values are stored in the memory 74 for each color, and thereafter test patterns of the colors are formed only in the image non-formation areas of the intermediate transfer belt 21, and shifts of the test patterns of the colors are detected. Then, for each color, a shift of the test pattern in the image formation area is obtained based on the two offset values and the detected shifts of the test patterns, and the position of an image to be formed in the image formation area is corrected.

Accordingly, it is not necessary to form test patterns of the colors in the image formation area of the intermediate transfer belt 21 after two offset values have been stored in the memory 74 for each color, and even while images of the colors are being formed in the image formation area of the intermediate transfer belt 21, the positions of images of the colors to be formed in the image formation area can be corrected by merely forming test patterns of the colors in the image non-formation areas. Further, since test patterns in both edge portions of the image formation area and the test patterns in the image non-formation areas are divided into two groups each made up of adjacent test patterns, and offset values respectively obtained from the groups are used, the influence of bow, for instance, can be suppressed, and the positions of images of the colors to be formed in the image formation area can be corrected more accurately.

The following is a detailed description of a procedure for obtaining two offset values for each color in the color image forming apparatus 1 according to the present embodiment.

Figure 3A:
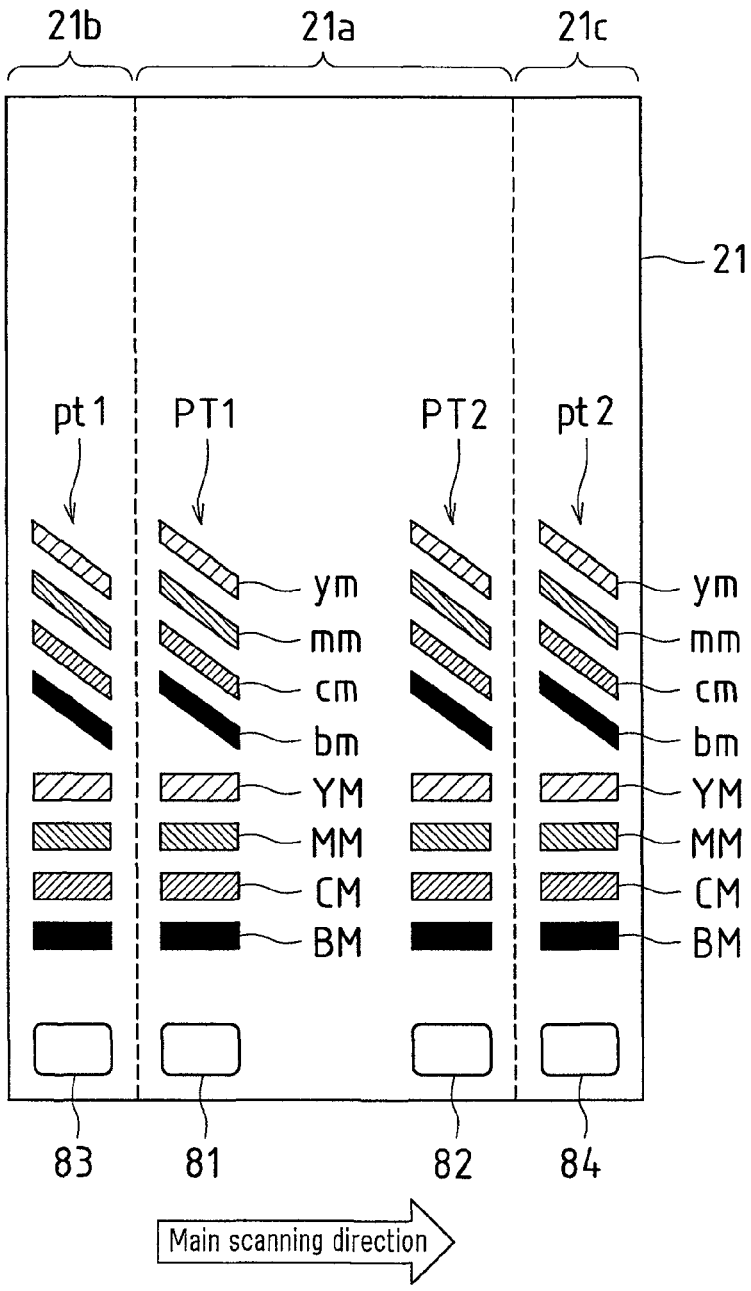
FIG. 3A is a plan view showing an intermediate transfer belt and registration sensors in the color image forming apparatus in FIG. 1.

First, as shown in FIG. 3A, an image formation area 21*a* in the center and image non-formation areas 21*b* and 21*c* on both sides are set on the surface of the intermediate transfer belt 21. Further, the surface of the photosensitive drums 13 also has an image formation area (not shown) that is in contact with the image formation area 21*a* of the intermediate transfer belt 21 and image non-formation areas (not shown) that are respectively in contact with the image non-formation areas 21*b* and 21*c* of the intermediate transfer belt 21.

The image formation areas of the intermediate transfer belt 21 and the photosensitive drums 13 are areas for forming normal images or test patterns of the colors. Electrostatic latent images are respectively formed in the image formation area of the photosensitive drums 13 using scanning beams emitted from the laser diodes of the laser exposing apparatus 11, and the electrostatic latent images in the image formation area of the photosensitive drums 13 are developed by the development apparatuses 12. Images of the colors or test patterns of the colors are formed in the image formation area of the photosensitive drums 13, then transferred from the image formation area of the photosensitive drums 13 to the image formation area 21*a* of the intermediate transfer belt 21, and formed thereon.

The image non-formation areas on both sides of the intermediate transfer belt 21 and the photosensitive drums 13 are not used for forming normal images, and are areas used only for forming test patterns of the colors. In the image non-formation areas as well, electrostatic latent images are respectively formed in the image non-formation areas on both sides of the photosensitive drums 13 using scanning beams emitted from the laser diodes of the laser exposing apparatus 11, and the electrostatic latent images in the image non-formation areas on both sides of the photosensitive drums 13 are developed by the development apparatuses 12. Test patterns of the colors are formed in the image non-formation areas on both sides of the photosensitive drums 13, then transferred from the image non-formation areas on both sides of the photosensitive drums 13 to the image non-formation areas 21*b* and 21*c* on both sides of the intermediate transfer belt 21, and formed thereon.

FIG. 3A shows test patterns PT1 and PT2 formed in both edge portions of the image formation area 21*a* of the intermediate transfer belt 21, and test patterns pt1 and pt2 formed in the image non-formation areas 21*b* and 21*c* on both sides of the intermediate transfer belt 21.

In all the test patterns PT1, PT2, pt1, and pt2, a black mark BM, a cyan mark CM, a magenta mark MM, and a yellow mark YM that are parallel to the main scanning direction are sequentially arranged in the sub-scanning direction, and subsequently a black mark bm, a cyan mark cm, a magenta mark mm, and a yellow mark ym that are obliquely inclined 45° relative to the main scanning direction are sequentially arranged in the sub-scanning direction.

Image data indicating these test patterns PT1, PT2, pt1, and pt2 is stored in the memory 74 in advance. When the image forming apparatus 1 is shipped from a factory or is standing by, in other words, when a normal image formation operation is not being performed, the control portion 71 instructs the print portion 72 to form the test patterns PT1, PT2, pt1, and pt2 on the intermediate transfer belt 21. In response thereto, the print portion 72 reads the image data indicating the test patterns PT1, PT2, pt1, and pt2 from the memory 74, gives that image data to the laser exposing apparatus 11, and forms electrostatic latent images of the test patterns PT1, PT2, pt1, and pt2, using the laser exposing apparatus 11, in both edge portions of the image formation area of the photosensitive drums 13 and the image non-formation areas on both sides of the photosensitive drums 13. Further, the print portion 72 develops, using the development apparatuses 12, the electrostatic latent images in both edge portions of the image formation area of the photosensitive drums 13 and the electrostatic latent images in the image non-formation areas on both sides of the photosensitive drums 13, forms the test patterns PT1 and PT2 in both edge portions of the image formation area of the photosensitive drums 13, and also forms the test patterns pt1 and pt2 in the image non-formation areas on both sides of the photosensitive drums 13. Then, the print portion 72 transfers the test patterns PT1 and PT2 in both edge portions of the image formation area of the photosensitive drums 13 to both edge portions of the image formation area 21*a* of the intermediate transfer belt 21 and forms the test patterns therein, and also transfers the test patterns pt1 and pt2 in the image non-formation areas on both sides of the photosensitive drums 13 to the image non-formation areas 21*b* and 21*c* on both sides of the intermediate transfer belt 21 and forms the test patterns therein.

Figure 3B:
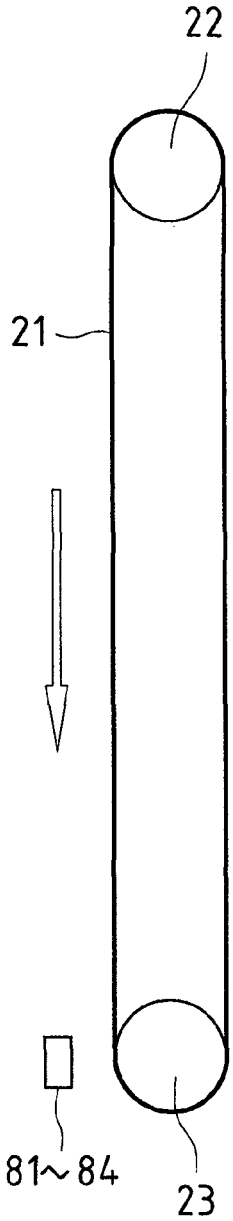
FIG. 3B is a lateral view showing the intermediate transfer belt and the registration sensors in the color image forming apparatus in FIG. 1.

As shown in FIGS. 3A and 3B, the registration sensors 81 and 82 that respectively detect the test patterns PT1 and PT2 are provided above both edge portions of the image formation area 21*a* of the intermediate transfer belt 21, and the registration sensors 83 and 84 that respectively detect the test patterns pt1 and pt2 are also provided above the image non-formation areas 21*b* and 21*c* of the intermediate transfer belt 21.

The registration sensors 81 to 84 respectively detect the test patterns PT1, PT2, pt1, and pt2 transported in the sub-scanning direction following the revolution of the intermediate transfer belt 21. At this time, for all the test patterns PT1, PT2, pt1, and pt2, the black mark BM, the cyan mark CM, the magenta mark MM, and the yellow mark YM are sequentially detected by the registration sensors, and the detection outputs thereof are successively inputted into the control portion 71.

When the detection outputs of the registration sensors 81 to 84 are inputted, the control portion 71 obtains, for all the test patterns PT1, PT2, pt1, and pt2, the recording positions in the sub-scanning direction of the marks BM, CM, MM and YM based on the detection timings at which the black mark BM, the cyan mark CM, the magenta mark MM, and the yellow mark YM are detected and the revolution speed of the intermediate transfer belt 21. Then, for each of the marks BM, CM, MM, and YM, the control portion 71 obtains a shift in the sub-scanning direction of a mark.

For example, the position in the sub-scanning direction of the black mark BM is assumed to be a reference position, and for each of the marks CM, MM, and YM, a prescribed separation distance of a mark from the reference position is obtained in advance and set. It is assumed that if all the marks CM, MM, and YM are recorded at positions separated by the respective prescribed separation distances from the reference position, the black marks BM, the cyan marks CM, the magenta marks MM, and the yellow marks YM transferred from the intermediate transfer belt 21 onto recording paper are completely superimposed, and thus no color shifts will occur.

Then, for each of the marks CM, MM, and YM recorded on the intermediate transfer belt 21, the separation distance from the recording positions of the black marks BM is obtained, the difference between the prescribed separation distance and the obtained separation distance of the recording position is obtained as a shift in the sub-scanning direction. Then, shifts in the sub-scanning direction for cyan, magenta, and yellow are stored in the memory 74.

Furthermore, the control portion 71 combines the test patterns PT1 and pt1 adjacent to each other, and for each of the marks CM, MM, and YM, calculates the difference between a shift in the sub-scanning direction of a mark in the test pattern pt1 and a shift in the sub-scanning direction of a mark in the test pattern PT1 (first sub-scanning offset value), and obtains first sub-scanning offset values for cyan, magenta, and yellow. Similarly, the control portion 71 combines the test patterns PT2 and pt2 adjacent to each other, and for each of the marks CM, MM, and YM, calculates the difference between a shift of a mark in the test pattern pt2 and a shift of a mark in the test pattern PT2 (second sub-scanning offset value), and obtains second sub-scanning offset values for cyan, magenta, and yellow.

The first and second sub-scanning offset values for cyan, magenta, and yellow obtained in this way are stored in the memory 74.

As shown in the upper diagram of FIG. 4, a main scanning line L on the intermediate transfer belt 21 is not a straight line orthogonal to the intermediate transfer belt 21, but curves or inclines, and thus there is so-called bow, for instance. This is due to the laser exposing apparatus 11 and the like, and occurs when electrostatic latent images are formed on the photosensitive drums 13. This bow, for instance, can be reduced by lens adjustment of the laser exposing apparatus 11 and the like, but cannot be completely eliminated. The degree of bow, for instance, differs for each color, and the degree of curving or inclination of the main scanning lines L for the colors also differs.

For this reason, assuming that a line 91 separated from the black main scanning line (reference position) by the prescribed separation distance is provided, shifts Δy1 and Δy2 in the sub-scanning direction of the main scanning line L in both edge portions of the image formation area 21*a* of the intermediate transfer belt 21 relative to the line 91 and shifts Δy3 and Δy4 in the sub-scanning direction of the main scanning line L in the image non-formation areas 21*b* and 21*c* relative to the line 91 differ from each other. In this case, the first sub-scanning offset value is represented by (Δy3−Δy1), and the second sub-scanning offset value is represented by (Δy4−Δy2).

Next, for all the test patterns PT1, PT2, pt1, and pt2, the registration sensors 81 to 84 sequentially detect the black mark bm, the cyan mark cm, the magenta mark mm, and the yellow mark ym obliquely inclined 45° relative to the main scanning direction, following the revolution of the intermediate transfer belt 21.

When the detection outputs of the registration sensors 81 to 84 are inputted, the control portion 71 obtains, for all the test patterns PT1, PT2, pt1, and pt2, the recording positions in the sub-scanning direction of the marks bm, cm, mm, and ym based on the detection timings respectively corresponding to the black mark bm, the cyan mark cm, the magenta mark mm, and the yellow mark ym and the revolution speed of the intermediate transfer belt 21. Then, for each of the marks bm, cm, mm, and ym, the control portion 71 obtains shifts in the main scanning direction of marks based on the recording positions in the sub-scanning direction of the marks and shifts (Δy1, Δy2, Δy3, Δy4) in the sub-scanning direction of the marks CM, MM, or YM obtained in advance and stored in the memory 74.

Since the marks bm, cm, mm, and ym are obliquely inclined 45° relative to the main scanning direction, if a mark is shifted by a fixed distance in the sub-scanning direction, the mark is also shifted by the same fixed distance in the main scanning direction, and if a mark is shifted by a fixed distance in the main scanning direction, the mark is also shifted by the same fixed distance in the sub-scanning direction. Thus, a shift in one direction is added to shifts in both directions. Accordingly, shifts in the main scanning direction of the marks bm, cm, mm, and ym can be obtained by subtracting shifts in the sub-scanning direction of the marks CM, MM, and YM from shifts in the sub-scanning direction of the marks bm, cm, mm, and ym.

Specifically, for each of the marks cm, mm, and ym, a prescribed separation distance of a mark from the reference position in the sub-scanning direction of the black mark bm is obtained in advance and set. For each of the marks cm, mm, and ym recorded on the intermediate transfer belt 21, the separation distance from the recording position of the black mark bm is obtained, and the difference between the prescribed separation distance and the obtained separation distance of the recording position is obtained as a shift in the sub-scanning direction. Then, shifts in the sub-scanning direction of the cyan, magenta, and yellow marks CM, MM, and YM are subtracted from shifts in the sub-scanning direction of cyan, magenta, and yellow marks cm, mm, and ym, thereby obtaining shifts in the main scanning direction for cyan, magenta, and yellow. Then, the shifts in the main scanning direction for cyan, magenta, and yellow are stored in the memory 74.

Furthermore, the control portion 71 combines the test patterns PT1 and pt1 adjacent to each other, and for each of the cyan, magenta, and yellow marks cm, mm, and ym, calculates the difference between a shift in the main scanning direction of a mark in the test pattern pt1 and a shift in the main scanning direction of a mark in the test pattern PT1 (first main scanning offset value), and obtains first main scanning offset values for cyan, magenta, and yellow. Similarly, the control portion 71 combines the test patterns PT2 and pt2 adjacent to each other, and for each of the cyan, magenta, and yellow marks cm, mm, and ym, calculates the difference between a shift of a mark in the test pattern pt2 and a shift of a mark in the test pattern PT2 (second main scanning offset value), and obtains second main scanning offset values for cyan, magenta, and yellow.

The first and second main scanning offset values for cyan, magenta, and yellow obtained in this way are stored in the memory 74.

As shown in the upper diagram of FIG. 5, due to the influence of bow, for instance, the distance between pixels Px at both ends on the main scanning line L (the length of the main scanning line L) is not constant, and the spacings between pixels Px on the main scanning line L are not constant, either. Further, the degree of bow, for instance, differs for each color, and the degree of variations of the pixels Px on the main scanning lines L of the colors also differs.

Accordingly, relative to the reference positions of black pixels 92 on the main scanning line, shifts Δx1 and Δx2 in the main scanning direction of the main scanning line L at both edge portions of the image formation area 21*a* and shifts Δx3 and Δx4 in the main scanning direction of the main scanning line L in the image non-formation areas 21*b* and 21*c* differ from each other. In this case, the first main scanning offset value is represented by (Δx3−Δx1), and the second main scanning offset value is represented by (Δx4−Δx2).

The following is an organized description of a procedure for obtaining the first and second sub-scanning offset values and the first and second main scanning offset values with reference to the flowchart in FIG. 6.

First, the test patterns PT1, PT2, pt1, and pt2 are read from the memory 74, the test patterns PT1 and PT2 are formed in both edge portions of the image formation area 21*a* of the intermediate transfer belt 21, and the test patterns pt1 and pt2 are formed in the image non-formation areas 21*b* and 21*c* on both sides of the intermediate transfer belt 21 (step S101).

Subsequently, for all the test patterns PT1, PT2, pt1, and pt2, the recording positions in the sub-scanning direction of the marks BM, CM, MM, YM, bm, cm, mm, and ym are detected using the registration sensors (step S102), and shifts in the sub-scanning direction and shifts in the main scanning direction for cyan, magenta, and yellow are obtained (step S103).

Furthermore, the test patterns PT1 and pt1 adjacent to each other are combined, and the first sub-scanning offset (Δy3−Δy1) value and the first main scanning offset value (Δx3−Δx1) are obtained for each color.

Similarly, the test patterns PT2 and pt2 adjacent to each other are combined, the second sub-scanning offset value (Δy4−Δy2) and the second main scanning offset value (Δx4−Δx2) are obtained for each color. Then, the first and second sub-scanning offset values and the first and second main scanning offset values are stored in the memory 74 (step S104).

The following is a description of a procedure in which when an image formation operation is being performed, and an image is formed in the image formation area 21*a* of the intermediate transfer belt 21, the test patterns pt1 and pt2 are respectively formed in the image non-formation areas 21*b* and 21*c* of the intermediate transfer belt 21, and then shifts in the sub-scanning direction and shifts in the main scanning direction are obtained based on the test patterns pt1 and pt2, and using these shifts and the first and second sub-scanning offset values and the first and second main scanning offset values stored in the memory 74, shifts in the sub-scanning direction and shifts in the main scanning direction in the image formation area 21*a* of the intermediate transfer belt 21 are obtained.

First, the control portion 71 instructs the print portion 72 to form the test patterns pt1 and pt2 on the intermediate transfer belt 21. In response thereto, the print portion 72 reads image data indicating the test patterns pt1 and pt2 from the memory 74, and forms, using the laser exposing apparatus 11, electrostatic latent images of the test patterns pt1 and pt2 in the image non-formation areas on both sides of the photosensitive drums 13. Using the development apparatuses 12, the print portion 72 develops the electrostatic latent images in the image non-formation area on both sides of the photosensitive drums 13, and forms the test patterns pt1 and pt2 in the image non-formation areas on both sides of the photosensitive drums 13. Then, the print portion 72 transfers the test patterns pt1 and pt2 in the image non-formation areas on both sides of the photosensitive drums 13 to the image non-formation areas 21*b* and 21*c* on both sides of the intermediate transfer belt 21, and forms the test patterns therein.

At this time, the registration sensors 83 and 84 respectively detect the test patterns pt1 and pt2 transported in the sub-scanning direction following the revolution of the intermediate transfer belt 21.

When the detection outputs of the registration sensors 83 and 84 are inputted, the control portion 71 obtains, for both the test patterns pt1 and pt2, the recording positions in the sub-scanning direction of the marks BM, CM, MM, and YM based on the detection timings respectively corresponding to the black mark BM, the cyan mark CM, the magenta mark MM, and the yellow mark YM and the revolution speed of the intermediate transfer belt 21. Then, for each of the marks BM, CM, MM, and YM, the control portion 71 obtains shifts in the sub-scanning direction of marks in the image non-formation areas 21*b* and 21*c* of the intermediate transfer belt 21.

Furthermore, for each of cyan, magenta, and yellow, the control portion 71 reads the first sub-scanning offset value from the memory 74, and obtains a shift in the sub-scanning direction in one edge portion of the image formation area 21*a* of the intermediate transfer belt 21 by subtracting the first sub-scanning offset value from a shift in the sub-scanning direction of a mark in the image non-formation area 21*b*, and also reads the second sub-scanning offset value from the memory 74, and obtains a shift in the sub-scanning direction in the other edge portion of the image formation area 21*a* of the intermediate transfer belt 21 by subtracting the second sub-scanning offset value from a shift in the sub-scanning direction of a mark in the image non-formation area 21*c*. Then, the control portion 71 averages the shifts in the sub-scanning direction in both edge portions of the image formation area 21*a*, and stores the average shift in the sub-scanning direction in the memory 74.

When the detection outputs of the registration sensors 83 and 84 are inputted, the control portion 71 obtains, for both the test patterns pt1 and pt2, the recording positions in the sub-scanning direction of the marks bm, cm, mm, and ym based on the detection timings respectively corresponding to the black mark bm, the cyan mark cm, the magenta mark mm, and the yellow mark ym and the revolution speed of the intermediate transfer belt 21. Then, the control portion 71 obtains shifts in the main scanning direction of the marks bm, cm, mm, and ym by subtracting the shifts in the sub-scanning direction of the marks CM, MM, and YM obtained in advance from the shifts in the sub-scanning direction of the marks bm, cm, mm, and ym.

Furthermore, for each of the cyan, magenta, and yellow, the control portion 71 reads the first main scanning offset value from the memory 74, and obtains a shift in the main scanning direction in one edge portion of the image formation area 21*a* of the intermediate transfer belt 21 by subtracting the first main scanning offset value from the shift in the main scanning direction of a mark in the image non-formation area 21*b*, and also reads the second main scanning offset value from the memory 74, and obtains a shift in the main scanning direction in the other edge portion of the image formation area 21*a* of the intermediate transfer belt 21 by subtracting the second main scanning offset value from the shift in the main scanning direction of a mark in the image non-formation area 21*c*. Then, the control portion 71 stores the shifts in the main scanning direction in both edge portions of the image formation area 21*a* of the intermediate transfer belt 21 in the memory 74.

Note that when the image forming apparatus 1 is shipped from a factory or is standing by, in other words, when a normal image formation operation is not being performed, the test patterns PT1 and PT2 can be formed in both edge portions of the image formation area 21*a*, and thus only the test patterns PT1 and PT2 may be formed, and a shift in the sub-scanning direction and a shift in the main scanning direction for each color may be obtained from the test patterns PT1 and PT2.

The following is an organized description of a procedure for obtaining an average shift in the sub-scanning direction of the image formation area 21*a* of the intermediate transfer belt 21 and shifts in the main scanning direction in both edge portions of the image formation area 21*a* as described, with reference to the flowchart in FIG. 7.

First, it is determined whether test patterns can be formed in the image formation area 21*a* (step S201). For example, if test patterns cannot be formed in the image formation area 21*a* ("No" in step S201) since an image formation operation is being performed, and an image is formed in the image formation area 21*a* of the intermediate transfer belt 21, the test patterns pt1 and pt2 are read from the memory 74, and formed in the image non-formation areas 21*b* and 21*c* on both sides of the intermediate transfer belt 21 (step S202).

Subsequently, for both the test patterns pt1 and pt2, the recording positions in the sub-scanning direction of the marks BM, CM, MM, YM, bm, cm, mm, and ym are detected using the registration sensor 83 or 84 (step S203), and shifts in the sub-scanning and main scanning directions for cyan, magenta, and yellow are obtained (step S204).

Furthermore, for each color, a shift in the sub-scanning direction in one edge portion of the image formation area 21*a* is obtained by subtracting the first sub-scanning offset value from the shift in the sub-scanning direction of a mark in the image non-formation area 21*b*, and also a shift in the sub-scanning direction in the other edge portion of the image formation area 21*a* is obtained by subtracting the second sub-scanning offset value from the shift in the sub-scanning direction of a mark in the image non-formation area 21*c*. Further, for each color, a shift in the main scanning direction in one edge portion of the image formation area 21*a* is obtained by subtracting the first main scanning offset value from the shift in the main scanning direction of a mark in the image non-formation area 21*b*, and also a shift in the main scanning direction in the other edge portion of the image formation area 21*a* is obtained by subtracting the second main scanning offset value from the shift in the main scanning direction of a mark in the image non-formation area 21*c* (step S205).

Then, for each color, the shifts in the main scanning direction in both edge portions of the image formation area 21*a* are stored in the memory 74, and further the shifts in the sub-scanning direction in both edge portions of the image formation area 21*a* are averaged, and thereafter the average shift in the sub-scanning direction is stored in the memory 74 (step S206).

Further, if test patterns can be formed in the image formation area 21*a* since an image formation operation is not being performed ("Yes" in step S201), the test patterns PT1 and PT2 are read from the memory 74, and formed in both edge portions of the image formation area 21*a* (step S207).

Subsequently, for both the test patterns PT1 and PT2, the recording positions in the sub-scanning direction of the marks BM, CM, MM, YM, bm, cm, mm, and ym are detected using the registration sensor 81 or 82 (step S208), and shifts in the sub-scanning and main scanning directions for cyan, magenta, and yellow are obtained (step S209).

Then, for each color, the shifts in the main scanning direction in both edge portions of the image formation area 21*a* are stored in the memory 74, and further the shifts in the sub-scanning direction in both edge portions of the image formation area 21*a* are averaged, and thereafter the average shift in the sub-scanning direction is stored in the memory 74 (step S210).

It is preferable to perform processing shown by the flowchart in FIG. 7 every time the fixed number of recording paper are printed or for each fixed period, for example. This is because the amount of toner consumption is excessively increased due to the formation of test patterns if the processing is frequently performed.

In this way, for each of cyan, magenta, and yellow, an average shift in the sub-scanning direction of the image formation area 21*a* of the intermediate transfer belt 21 and shifts in the main scanning direction in both edge portions of the image formation area 21*a* are obtained, and thereafter the image position on the intermediate transfer belt 21 is corrected for each color, using the average shift in the sub-scanning direction and the shifts in the main scanning direction in both edge portions, thereby suppressing color shifts. However, the image position of a black image will not be corrected since a black image is used as a reference.

For example, the image positions in the sub-scanning direction in the image formation area 21*a* of the intermediate transfer belt 21 are corrected by controlling, for instance, the writing timings at which electrostatic latent images are written on the photosensitive drums 13 using scanning beams emitted from the laser diodes of the laser exposing apparatus 11, so as to adjust a sub-scanning direction position of a main scanning line on the photosensitive drums 13 by the average shift in the sub-scanning direction.

As long as the first sub-scanning offset value ($\Delta y3-\Delta y1$) and the second sub-scanning offset value ($\Delta y4-\Delta y2$) as shown in the upper diagram of FIG. 4 have been obtained, while an image formation operation is being performed, the shifts $\Delta y3$ and $\Delta y4$ in the sub-scanning direction in the image non-formation areas 21*b* and 21*c* are detected, and the shift $\Delta y3$ in the sub-scanning direction in the image non-formation area 21*b* is subtracted from the first sub-scanning offset value ($\Delta y3-\Delta y1$), whereby the shift $\Delta y1$ in the sub-scanning direction in one edge portion of the image formation area 21*a* can be obtained. Further, if the shift $\Delta y4$ in the sub-scanning direction in the image non-formation area 21*c* is subtracted from the second sub-scanning offset value ($\Delta y4-\Delta y2$), the shift $\Delta y2$ in the sub-scanning direction in the other edge portion of the image formation area 21*a* can be obtained. Furthermore, the average shift in the sub-scanning direction of the image formation area 21*a* $(\Delta y1+\Delta y2)/2$ is obtained, and the sub-scanning direction position of the main scanning line L is adjusted by the average shift in the sub-scanning direction $(\Delta y1+\Delta y2)/2$ as shown in the middle diagram of FIG. 4, whereby the image position in the sub-scanning direction in the image formation area 21*a* of the intermediate transfer belt 21 is accurately corrected.

If the sub-scanning direction position of the main scanning line L were to be adjusted by the shifts $\Delta y3$ and $\Delta y4$ in the sub-scanning direction of the image non-formation areas 21*b* and 21*c* as shown in the lower diagram of FIG. 4, the image position in the sub-scanning direction would be excessively corrected.

The length and the main scanning direction position of the main scanning line are adjusted by adjusting the start position and the end position of the main scanning line on the photosensitive drums 13 by the shifts in the main scanning direction in both edge portions, whereby the image position in the main scanning direction is corrected.

As long as the first main scanning offset value (Δx3−Δx1) and the second main scanning offset value (Δx4−Δx2) as shown in the upper diagram of FIG. 5 have been obtained, while an image formation operation is being performed, the shifts Δx3 and Δx4 in the main scanning direction in the image non-formation areas 21*b* and 21*c* are detected, and the shift Δx3 in the main scanning direction in the image non-formation area 21*b* is subtracted from the first main scanning offset value (Δx3−Δx1), whereby the shift Δx1 in the main scanning direction in one edge portion of the image formation area 21*a* can be obtained. Further, if the shift Δx4 in the main scanning direction in the image non-formation area 21*c* is subtracted from the second main scanning offset value (Δx4−Δx2), the shift Δx2 in the main scanning direction in the other edge portion of the image formation area 21*a* can be obtained. Furthermore, if the positions of the pixels Px on the main scanning line L are adjusted according to the shifts Δx1 and Δx2 in the main scanning direction in both edge portions as shown in the middle diagram of FIG. 5, and the pixels Px on the main scanning line L are arranged, the image position in the main scanning direction in the image formation area 21*a* of the intermediate transfer belt 21 is accurately corrected.

If the positions of the pixels Px on the main scanning line L were to be adjusted according to the shifts Δx3 and Δx4 in the main scanning direction of the image non-formation areas 21*b* and 21*c* as shown in the lower diagram of FIG. 5, the image position in the main scanning direction would be excessively corrected.

As described, in the present embodiment, the test patterns of the colors are formed in all the image formation area 21*a* and the image non-formation areas 21*b* and 21*c* of the intermediate transfer belt 21, shifts of the test patterns of the colors formed in the image formation area 21*a* and shifts of the test patterns of the colors formed in the image non-formation areas 21*b* and 21*c* are detected, and for each color, offset values indicating offsets between shifts of the test patterns in the image formation area 21*a* and shifts of the test patterns in the image non-formation areas 21*b* and 21*c* are obtained, and stored in the memory 74. Based on such offset values for the colors and shifts of the test patterns of the colors formed in the image non-formation areas 21*b* and 21*c*, shifts of the test patterns of the colors in the image formation area 21*a* can be derived.

Accordingly, even while an image is being formed in the image formation area 21*a*, if test patterns of the colors are formed in the image non-formation areas 21*b* and 21*c*, and shifts of the test patterns of the colors are detected, based on the offset values for the colors and the shifts of the test patterns of the colors, shifts of test patterns of the colors in the image formation area 21*a* can be obtained, whereby the positions of images of the colors to be formed in the image formation area 21*a* can be corrected.

Although a preferred embodiment of the present invention has been described above with reference to the accompanying drawings, it goes without saying that the present invention is not limited to the example. It is apparent that those skilled in the art would be able to conceive various modifications and alterations within the scope described by the claims, and naturally all of these are to be interpreted as belonging to the technical scope of the present invention.

For example, in the above embodiment, although four test patterns are formed in both edge portions of the image formation area 21*a* and the image non-formation areas 21*b* and 21*c* of the intermediate transfer belt 21, and two offset values are obtained from two groups each made up of test patterns adjacent to each other, the test patterns may be formed only in the image formation area 21*a* and one of the image non-formation areas 21*b* and 21*c* of the intermediate transfer belt 21, one offset value may be obtained from these test patterns, and the recording position of an image may be corrected using this offset.

The present invention is also applicable to color image forming apparatuses having other configurations. For example, the present invention is also applicable to a color image forming apparatus that directly transfers images of the colors from latent image carriers to a recording medium (recording paper).

The present invention may be embodied in various other forms without departing from the gist or essential characteristics thereof. Therefore, the embodiment disclosed herein is to be considered in all respects as illustrative and not limiting. The scope of the invention is indicated by the appended claims rather than by the foregoing description. All variations and modifications falling within the equivalency range of the appended claims are intended to be embraced therein.

What is claimed is:

1. A color image forming apparatus that forms test patterns of a plurality of colors on an image carrier, detects a shift of each of the test patterns of the plurality of colors formed on the image carrier, and corrects a position of an image of each of the plurality of colors to be formed on the image carrier based on the shifts of the test patterns of the plurality of colors, the apparatus comprising:

a test pattern formation portion that forms the test patterns of the plurality of colors in an image formation area in which images of the plurality of colors are formed on the image carrier and in an image non-formation area provided on both sides of the image formation area on the image carrier;

a detection portion that detects a shift of each of the test patterns of the plurality of colors formed in the image formation area and a shift of each of the test patterns of the plurality of colors formed in the image non-formation area;

a computing portion that divides the test patterns in both edge portions of the image formation area and the test patterns in the image non-formation areas into two groups each made up of adjacent test patterns and computes a shift between the test pattern in the image non-formation area and the test pattern in the image formation area; and a storage portion that stores the shift computed by the computing portion.

2. The color image forming apparatus according to claim 1, wherein the offset values are obtained in advance and stored in the storage portion, the test pattern formation portion forms the test patterns of the plurality of colors in the image non-formation area, and the detection portion detects a shift of each of the test patterns of the plurality of colors formed in the image non-formation area, the computing portion has a function of obtaining, for each color, a shift of a test pattern in the image formation area based on the shift of the test pattern formed in the image non-formation area and the offset value stored in the storage portion, and positions of images of the plurality of colors to be formed on the image carrier are corrected based on the shifts of the test patterns of the plurality of colors in the image formation area obtained by the computing portion.

3. The color image forming apparatus according to claim 2, wherein formation of the test patterns in the image non-formation area by the test pattern formation portion and detection of the shifts of the test patterns in the image non-formation area by the detection portion are performed when images of the plurality of colors are formed in the image formation area.

4. The color image forming apparatus according to claim 1, wherein formation of the test patterns in the image formation area and the test patterns in the image non-formation area by the test pattern formation portion and detection of the shifts of the test patterns in the image formation area and the shifts of the test patterns in the image non-formation area by the detection portion are performed when images of the plurality of colors are not formed in the image formation area.

5. The color image forming apparatus according to claim 1, wherein a position of a test pattern of one of the plurality of colors is used as a reference position, and a shift of each of the test patterns of the plurality of colors is obtained as a shift of a position of a test pattern of another color relative to the reference position.

6. The color image forming apparatus according to claim 1, comprising:

a latent image carrier for each of the plurality of colors;

a latent-image writing portion that writes a latent image on each of the latent image carriers;

a development portion that develops the latent image on each of the latent image carriers, and forms images of the plurality of colors on the latent image carriers; and a transfer portion that transfers the images of the plurality of colors from the latent image carriers to the image carrier, and forms the images of the plurality of colors on the image carrier, wherein the latent-image writing portion adjusts a writing timing at which a latent image is written on each of the latent image carriers according to the shifts of the test patterns of the plurality of colors obtained by the computing portion, and corrects positions of images of the plurality of colors to be formed on the image carrier.

7. The color image forming apparatus according to claim 1, wherein the computing portion obtains, for each of the plurality of colors, an offset value indicating an offset between the shift of the test pattern in the image non-formation area and the shift of the test pattern in the image formation area.

8. A color image forming apparatus that forms test patterns of a plurality of colors on an image carrier, detects a shift of each of the test patterns of the plurality of colors formed on the image carrier, and corrects a position of an image of each of the plurality of colors to be formed on the image carrier based on the shifts of the test patterns of the plurality of colors, the apparatus comprising:

a test pattern formation portion that forms the test patterns of the plurality of colors in an image formation area in which images of the plurality of colors are formed on the image carrier and in an image non-formation area outside the image formation area on the image carrier;

a detection portion that detects a shift of each of the test patterns of the plurality of colors formed in the image formation area and a shift of each of the test patterns of the plurality of colors formed in the image non -formation area;

a computing portion that obtains, for each color, an offset value indicating an offset between the shift of the test pattern in the image non-formation area and the shift of the test pattern in the image formation area; and a storage portion that stores the offset value for each color, wherein the test pattern formation portion forms the test patterns of the plurality of colors in the image non-formation area and the detection portion detects a shift of each of the test patterns of the plurality of colors formed in the image non-formation area, the computing portion has a function of obtaining for each color; a shift of a test pattern in the image formation area based on the shift of the test pattern formed in the image non -formation area and the offset value stored in the storage portion, and positions of images of the plurality of colors to be formed on the image carrier are corrected based on the shifts of the test patterns of the plurality of colors in the image formation area obtained by the computing portion.

9. The color image forming apparatus according to claim 8, wherein formation of the test patterns in the image non-formation area by the test pattern formation portion and detection of the shifts of the test patterns in the image non-formation area by the detection portion are performed when images of the plurality of colors are formed in the image formation area.

10. The color image forming apparatus according to claim 8, wherein formation of the test patterns in the image formation area and the test patterns in the image non-formation area by the test pattern formation portion and detection of the shifts of the test patterns in the image formation area and the shifts of the test patterns in the image non-formation area by the detection portion are performed when images of the plurality of colors are not formed in the image formation area.

11. The color image forming apparatus according to claim 8, wherein a position of a test pattern of one of the plurality of colors is used as a reference position, and a shift of each of the test patterns of the plurality of colors is obtained as a shift of a position of a test pattern of another color relative to the reference position.

12. The color image forming apparatus according to claim 8, comprising:

a latent image carrier for each of the plurality of colors;

a latent-image writing portion that writes a latent image on each of the latent image carriers;

a development portion that develops the latent image on each of the latent image carriers, and forms images of the plurality of colors on the latent image carriers; and a transfer portion that transfers the images of the plurality of colors from the latent image carriers to the image carrier, and forms the images of the plurality of colors on the image carrier, wherein the latent-image writing portion adjusts a writing timing at which a latent image is written on each of the latent image carriers according to the shifts of the test patterns of the plurality of colors obtained by the computing portion, and corrects positions of images of the plurality of colors to be formed on the image carrier.

* * * * *